US007972526B2

(12) United States Patent
Murphy et al.

(10) Patent No.: US 7,972,526 B2
(45) Date of Patent: Jul. 5, 2011

(54) GREASE RESISTANT COATINGS, ARTICLES AND METHODS

(75) Inventors: Christopher B. Murphy, Woodridge, IL (US); Jon O. Fabri, Charleston, SC (US); Robert P. Mahoney, Newbury, MA (US)

(73) Assignee: Polymer Ventures, Inc., Charleston, SC (US)

( * ) Notice: Subject to any disclaimer, the term of this patent is extended or adjusted under 35 U.S.C. 154(b) by 0 days.

(21) Appl. No.: 12/630,454

(22) Filed: Dec. 3, 2009

(65) Prior Publication Data

US 2010/0304116 A1 Dec. 2, 2010

Related U.S. Application Data

(62) Division of application No. 12/476,037, filed on Jun. 1, 2009.

(51) Int. Cl.
*D06M 15/263* (2006.01)

(52) U.S. Cl. ..... 252/8.62; 427/384; 106/287.26

(58) Field of Classification Search ..... 427/384; 252/8.62; 106/287.26
See application file for complete search history.

(56) References Cited

U.S. PATENT DOCUMENTS

| | | | | |
|---|---|---|---|---|
| 2,251,296 | A * | 8/1941 | Shipp | 428/211.1 |
| 3,218,191 | A * | 11/1965 | Domanski | 427/302 |
| 3,485,656 | A * | 12/1969 | Merchant et al. | 427/302 |
| 3,650,805 | A * | 3/1972 | Imoto et al. | 427/341 |
| 3,758,324 | A | 9/1973 | Barrett | |
| 4,559,186 | A | 12/1985 | Lee | |
| 5,141,797 | A | 8/1992 | Wheeler | |
| 5,981,011 | A * | 11/1999 | Overcash et al. | 428/40.9 |
| 2005/0042443 | A1 * | 2/2005 | Miller | 428/341 |
| 2008/0064814 | A1 | 3/2008 | Yamamoto et al. | |

OTHER PUBLICATIONS

International Search Report and Written Opinion for corresponding International application No. PCT/US2010/036123, dated Aug. 5, 2010.

* cited by examiner

*Primary Examiner* — Dah-Wei D Yuan
*Assistant Examiner* — Robert S Walters, Jr.
(74) *Attorney, Agent, or Firm* — Marshall, Gerstein & Borun LLP

(57) ABSTRACT

Disclosed herein is an environmentally safe, grease resistant article comprising an absorbent substrate, a cross-linking agent, and a polymer; wherein the substrate is first coated with the cross-linking agent and is then coated with the polymer.

18 Claims, 1 Drawing Sheet

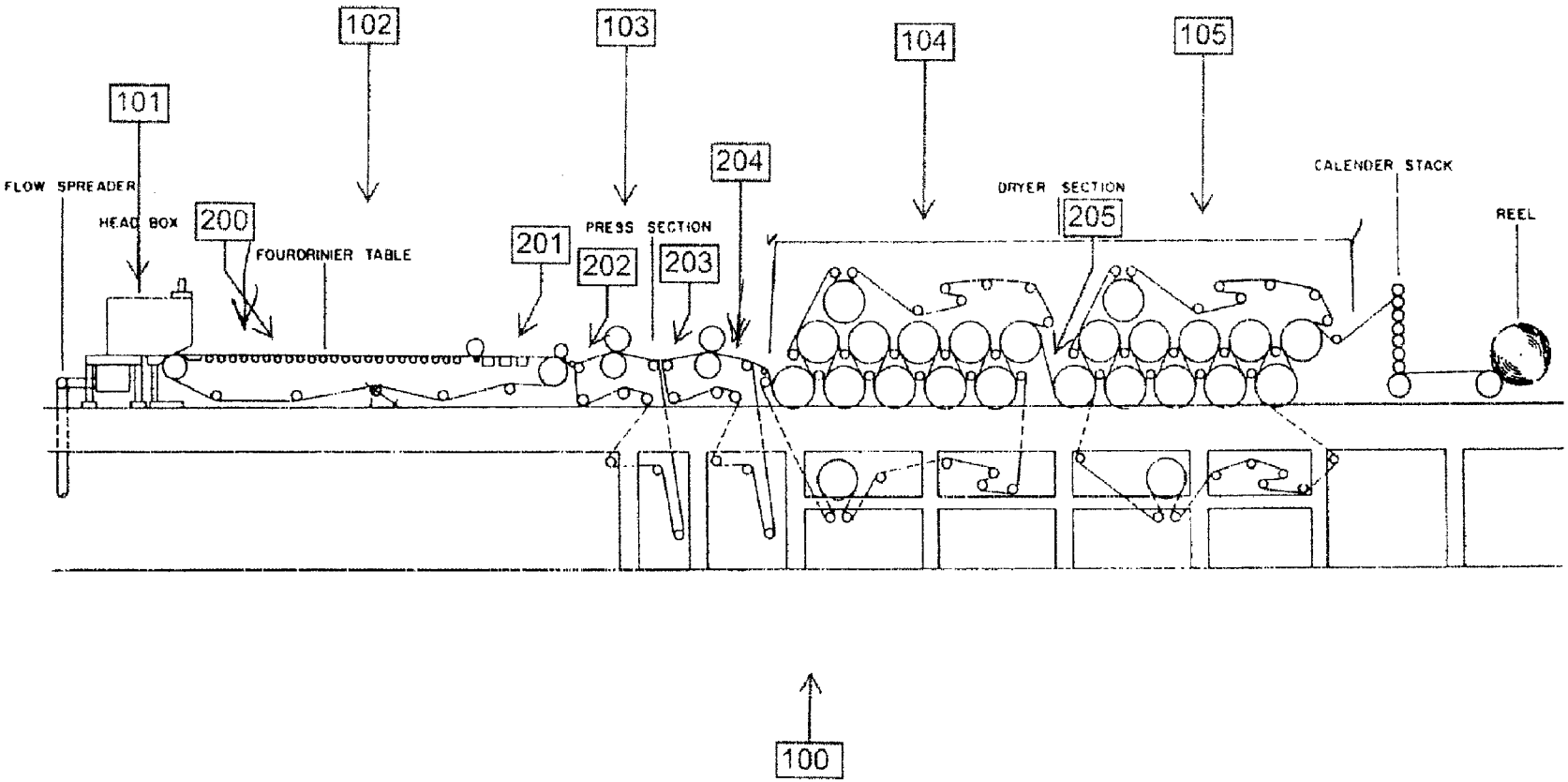
REEL
CALENDER STACK
105
DRYER SECTION
205
104
204
PRESS SECTION
203
103
202
201
102
FOURDRINIER TABLE
200
101
HEAD BOX
FLOW SPREADER
100

GREASE RESISTANT COATINGS, ARTICLES AND METHODS

CROSS-REFERENCE TO RELATED APPLICATION

This application is a divisional of pending U.S. patent application Ser. No. 12/476,037, filed Jun. 1, 2009, the disclosure of which is incorporated herein in its entirety.

FIELD OF THE DISCLOSURE

The disclosure generally relates to improved grease resistant coatings, articles, and methods and, more specifically, to grease resistant substrates, particularly paper.

BRIEF DESCRIPTION OF RELATED TECHNOLOGY

Materials, such as paper and textiles, are commonly treated or coated to improve their resistance to liquids such as water, grease and oil. Commercial fluorochemical compounds, such as those sold by DuPont Co. and Mitsubishi Chemical Co., Ltd., are widely used to improve the repellent properties of substrates, like papers, textile fabrics, nonwoven fabrics, upholstery, and carpet fibers.

The use of fluorochemicals to improve substrate repellent properties are the object of health and environmental concerns because of their persistence and tendency to bioaccumulate. An additional problem associated with the use of fluorochemicals on substrates, such as paper, is the effect the fluorochemical coatings have on the recycling of the substrate. The inclusion of the fluorochemical coatings prevents current reclamation systems from cost-effectively recycling the coated paper. Consequently, there is strong interest in replacing or reducing the use of fluorochemical compounds such as perfluorooctane sulfonate (PFOS), perfluorooctanoate (PFOA), polytetrafluoroethylene (PTFE), perfluoro-n-decanoic acid (PFDA) and other perfluorinated compounds that are widely used for imparting grease, oil, and/or water resistance to the substrates to which they are applied.

Recently several products have been introduced into the marketplace as potential replacements for the fluorochemical compounds. Often these materials are based on inorganic materials like silica, organic polymers, or combinations of these materials. However, to date, these replacements have fallen short of the cost/performance standards established by the use of fluorinated compounds. One class of materials that have been extensively used in place of the fluorochemical coatings are waxes. It is well known that the repellent properties of various materials are modified by the addition of a wax, and paraffin waxes have been used in many surface treatments. U.S. Pat. No. 4,117,199 provides examples of the use of waxes for surface treatment, coating, and the like.

Another organic material that has been used to coat substrates is poly(vinyl alcohol) (PVOH). The application of PVOH has included the formation of films and/or coatings for water dispersability and/or repellent properties. Examples of PVOH coatings can be found in U.S. Pat. Nos. 5,468,526; 5,110,390; 5,283,090; 6,113,978; and U.S. 2005/0042443 A1. Optionally, the PVOH can be used in polymer mixtures as described in U.S. Pat. No. 5,981,011.

Yet another organic material that has been used to coat substrates is a cellulose-based polymer, optionally including PVOH, as described in U.S. patent application Ser. No. 11/857,630. This application teaches that satisfactory grease-resistance can be achieved when paper is coated with at least 6.4 g/m2 of the cellulose-based polymer. The application also teaches the addition of a cellulose cross-linking agent to the cellulose-based polymer to prevent dissolution of the polymer after coating. There, the cross-linking agent was added either to the cellulose-based polymer treatment composition or was applied to the coated cellulose coated substrate by a second coating step.

Generally, the prior art does not sufficiently teach or suggest to one of ordinary skill in the art how to achieve excellent grease resistance for substrates coated with cross-linked PVOH. The prior art does not teach or suggest a method of treating substrates or applying to substrates cross-linked PVOH films or coatings that provide excellent grease resistance with a very low loading of polymer. Additionally, the prior art neither teaches nor suggests a recyclable and biodegradable grease resistant article.

SUMMARY OF THE INVENTION

Disclosed herein is an article formed from an absorbent substrate and a cross-linked poly(vinyl alcohol) that exhibits excellent grease-resistance, and a method for making the same.

Additional features of the invention may become apparent to those skilled in the art from a review of the following detailed description, taken in conjunction with the drawings, the examples, and the appended claims.

BRIEF DESCRIPTION OF THE DRAWING FIGURES

For a more complete understanding of the disclosure, reference should be made to the following detailed description and accompanying drawing wherein the FIGURE is a drawing of a Fourdrinier paper machine.

While the disclosed articles and methods are susceptible of embodiments in various forms, there are illustrated in the drawing (and will hereafter be described) specific embodiments of the invention, with the understanding that the disclosure is intended to be illustrative, and is not intended to limit the invention to the specific embodiments described and illustrated herein

DETAILED DESCRIPTION OF THE INVENTION

The articles and methods described herein may be understood more readily by reference to the following detailed description and the examples provided therein. It is to be understood that this invention is not limited to the specific components, articles, processes and/or conditions described, as these may, of course, vary. It is also to be understood that the terminology used herein is for the purpose of describing particular embodiments only and is not intended to be limiting.

Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The articles and methods described herein generally relate to environmentally safe, grease resistant articles and methods. An important aspect of the development of new industrial chemicals and processes is the reduction of the environmental hazards associated with the chemicals and/or processes.

Apart from the direct health implications of toxic materials, industrial use of hazardous material is increasing manufacturing costs due to, in part, emission restrictions. Herein, the grease resistant articles, coatings, and methods for manufacture, employ materials significantly less hazardous to people and the environment, than those currently employed, e.g., fluorocarbons. Moreover, the coatings and coated articles described herein neither contaminate nor impede recycling processes.

The coatings described herein are applied to substrates that are initially water absorbent. The absorbency of water by a substrate can occur for example by capillary action, hydrophilic interactions, swelling, absorption, adsorption, and the like. Broadly, one of ordinary skill would understand water absorbent substrates to become wet when a water solution is applied.

Often the applicable substrates are derived directly or through processing from agricultural products. For example, wood, cotton, wheat straw, hemp, grasses, bagasse, and corn have been processed to fibers or pulp for the manufacture of textiles and paper. Alternatively, applicable substrates are produced from synthetic materials, for example those yarns manufactured for the production of textiles. Example of a yarn produced from agricultural products and/or synthetic material includes acetate, acrylic, cotton, wool, nylon, and polyester spuns and blends such as polyester/cotton, polyester/wool, and polyester/rayon.

The structure of an absorbent substrate includes: papers, boards, textiles, leathers, ceramics, and the like. Examples of papers include but are not limited to tissue paper, toilet paper, paper, paperboard, and cardboard. Examples of boards include but are not limited to insulationboard, medium density fiberboard, hardboard, wood composition board, gypsum board, wall board, and plaster board. Textiles can be woven or nonwoven textiles made from natural and/or synthetic materials. Examples of textiles include but are not limited to carpeting, upholstery, window coverings, table coverings, bed coverings, towels, napkins, filters, flags, backpacks, tents, nets, balloons, kites, sails, parachutes, and clothing. Leathers include artificial leather and natural leather.

A nonlimiting list of natural materials that can be employed in woven or nonwoven textiles includes cotton, hemp, wool, and hair. A nonlimiting list of synthetic materials that can be employed as woven or nonwoven textiles includes polymer filaments of polyethylene, polystyrene, polypropylene, polyester (e.g., polyethylene terephthalate), polymer blends, copolymers, and the like.

An important aspect of the present invention is the treatment of the substrate with a coating polymer. The coating polymer may be water-soluble, water-insoluble, or partially water-soluble and is not gelled prior to contacting the substrate. Preferably the coating polymer is soluble in water, more preferably the coating polymer forms homogeneous, non-gelled solutions in water from which uniform films can be applied on a substrate. Gellation of the coating polymer prior to contacting the substrate should be avoided and the unacceptable gelling or gellation of the polymer coating material is hereby defined as the state that the coating polymer, prior to contacting the substrate, wherein too much cross-linking has occurred such that the polymer acts as a solid and exhibits no flow when at rest. Examples of polymer and cross-linker applications include but are not limited to spraying, coating, dip-coating, painting, printing, and the like. The coating polymer can be a single polymer, a blend of a plurality of polymers, or a blend of polymer(s) and surface treatment aids.

The herein described preferred coating polymers contain a plurality of hydroxyl groups. These polymers, often called polymer polyols or simply polyols, can be characterized by the number of hydroxyl groups on the polymer. One means for determining and reporting the number of hydroxyl groups is by the hydroxyl number of the polymer. A hydroxyl number is determined by measuring the amount in milligrams of potassium hydroxide that is needed to neutralize the acetic acid that is formed when acetic anhydride and pyridine are reacted with 1 g of the polymer. The hydroxyl number is reported in milligrams KOH per gram of polymer (mg KOH/g). This technique, well known in the art, is an easy means for determining the density of hydroxyl groups on a polymer backbone. The polymers applicable herein have hydroxyl numbers greater than about 20 mg KOH/g, preferably greater than about 50 mg KOH/g, more preferably greater than 100 mg KOH/g, and still more preferably greater than 200 mg KOH/g.

Useful polyols have a weight average molecular weight of about 500 to about 20,000,000 Dalton. One of ordinary skill in the art would understand that the weight average molecular weight of the employed polyol is dependent on the chemical structure and characteristics of the polyol. For example, a poly(vinyl alcohol) polyol preferably has a weight average molecular weight of about 500 to about 10,000,000 Daltons whereas a polysaccharide polyol preferably has a weight average molecular weight of about 10,000 to about 20,000,000 Daltons.

One class of preferable polyol is poly(vinyl alcohol), PVOH, or a copolymer thereof. Poly(vinyl alcohol) is typically produced by hydrolyzing polyvinyl acetate to replace the acetate groups with alcohol groups. The number of acetate groups that are replaced are generally referenced by the percent hydrolysis. Those of ordinary skill in the art believe that the greater the degree of hydrolysis, the higher the percentage, the better the polyol barrier properties. Another class of preferable polyol is polysaccharide or a copolymer thereof.

The production of PVOH yields polymers with various viscosities and degrees of hydrolysis. Viscosity is generally understood to be a function of the molecular weight of PVOH and commercial PVOHs are generally sold based on viscosity ranges not weight average molecular weights. Examples of commercially available PVOHs useful in the articles and methods described herein include but are not limited to PVOHs with the following viscosities and degrees of hydrolysis:

| | | Viscosity | % hydrolyzed |
|---|---|---|---|
| Partially Hydrolyzed | | | |
| MOWIOL | 3-85 | 3.4-4.0 | 84.2-86.2 |
| MOWIOL | 4-88 | 3.5-4.5 | 86.7-88.7 |
| MOWIOL | 5-88 | 5.0-6.0 | 86.7-88.7 |
| ELVANOL | 51-05 | 5.0-6.0 | 87.0-89.0 |
| MOWIOL | 8-88 | 7.0-9.0 | 86.7-88.7 |
| MOWIOL | 13-88 | 11.5-14.5 | 86.7-88.7 |
| MOWIOL | 18-88 | 16.5-19.5 | 86.7-88.7 |
| MOWIOL | 23-88 | 21.5-24.5 | 86.7-88.7 |
| ELVANOL | 52-22 | 23.0-27.0 | 87.0-89.0 |
| MOWIOL | 26-88 | 24.5-27.5 | 86.7-88.7 |
| MOWIOL | 32-88 | 30.0-34.0 | 86.7-88.7 |
| MOWIOL | 40-88 | 38.0-42.0 | 86.7-88.7 |
| MOWIOL | 47-88 | 45.0-49.0 | 86.7-88.7 |
| ELVANOL | 50-42 | 44.0-50.0 | 87.0-89.0 |
| MOWIOL | 56-88 | 52.0-60.0 | 86.7-88.7 |

-continued

| | | Viscosity | % hydrolyzed |
|---|---|---|---|
| Intermediately Hydrolyzed | | | |
| ELVANOL | 70-14 | 13.0-16.0 | 95.0-97.0 |
| ELVANOL | 70-27 | 25.0-30.0 | 95.5-96.5 |
| ELVANOL | 60-30 | 27.0-33.0 | 90.0-93.0 |
| MOWIOL | 30-92 | 28.0-32.0 | 91.5-93.3 |
| Fully Hydrolyzed | | | |
| MOWIOL | 4-98 | 4.0-5.0 | 98.0-98.8 |
| MOWIOL | 6-98 | 5.0-7.0 | 98.0-98.8 |
| ELVANOL | 70-06 | 6.0-7.0 | 98.0-99.0 |
| MOWIOL | 10-98 | 9.0-11.0 | 98.0-98.8 |
| MOWIOL | 20-98 | 18.5-21.5 | 98.0-98.8 |
| ELVANOL | 71-30 | 27.0-33.0 | 98.0-99.0 |
| MOWIOL | 30-98 | 28.5-31.5 | 98.0-98.8 |
| MOWIOL | 56-98 | 52.0-60.0 | 98.0-98.8 |

The MOWIOL product line is available from KURARAY AMERICA, Inc., Houston Tex.; the ELVANOL product line is available from DUPONT Co., Wilmington Del. Viscosity is measured for a 4% solids aqueous solution at 20° C.

Applicable PVOHs have a viscosity less than about 60 cP, preferably a viscosity less than about 30 cP, more preferably a viscosity less than about 15 cP, and most preferably a viscosity less than about 10 cP, when measured at a 4% PVOH by weight in aqueous solution. While the coating technology art teaches that PVOH coatings employing PVOHs with higher molecular weights are superior grease resistant coatings, the coatings and methods of making the coatings disclosed herein were found to be superior when lower molecular weight (lower viscosity) PVOHs were used.

Optionally, additional hydroxyl containing polymers may be included in the herein described coatings. When the coating polymer is a PVOH or copolymer thereof, non-limiting examples of additional polyols include polysaccharides, oligosaccharides, and the like. Non-limiting examples of polysaccharides include glucan, glycogen, starch, cellulose, dextran, maltodextrin, fructan, mannan, chitin, and the like. Additionally, polysaccharide polymers include those polymers that are derived from sugar repeat units, including copolymers of sugar repeat units and other repeat units, and polymers and/or copolymers of repeat units derived from sugar repeat units. If applied to a paper substrate, the other hydroxyl containing polymer preferably does not produce an odor or color the paper upon the typical heating utilized in the paper making process. Additionally, the other hydroxyl containing polymers are miscible with poly(vinyl alcohol) or aqueous solutions of poly(vinyl alcohol), and form uniform coatings. In one embodiment, the coating polymer contains no cellulose-based polymer(s), particularly no cellulose either or cellulose ester polymers.

The coating polymer can be a blend of a plurality of polymers wherein the plurality includes at least one polyol, preferably a water-soluble polyol. The other polymers can be hydroxyl containing polymers, fluoropolymers, polyurethanes, nylons, polycarbonates, polyalkenes, polyacrylates, polyvinylcholorides, silicones, polystyrenes, celluloses, starches, polyisoprenes, proteins, cationic polymers, and copolymers, blends, and/or derivatives thereof. Preferably, the other polymers contribute to the grease repellent, grease resistant properties of the articles described herein. More preferably, the other polymers are not directly detrimental to the grease resistant properties described herein.

The coating polymer can additionally be a blend of polymer(s) and surface treatment aids. Examples of surface treatment aids include but are not limited to waxes, wax emulsions, gels, clays, minerals, surfactants, and the like. Additional water repellant characteristics may be added to the substrate by the addition of, for example, other polymers or copolymers, e.g., silicones, siloxanes, stearylated melamine, calcium stearates, alkyl succinic anhydrides, alkyl ketene dimers, latex binders (i.e. styrene-butadiene co-polymers, styrene acrylonitrile butadiene co-polymers), SB-R (rubber) copolymers, poly (vinylacetate) and copolymers thereof, or the like.

Another important aspect of the present disclosure is the reaction of the coating polymer with a cross-linking agent. The cross-linking agent can be water-soluble, water-insoluble, or partially water-soluble. One of ordinary skill understands that the specific coating polymer and the specific cross-linking agent are mutually dependant. Preferably, the cross-linking agent reacts with the hydroxyl functionality of a water-soluble polymer, e.g., polyol. Examples of organic cross-linking agents include chloroformate esters; ureas; urea formaldehyde polymers; polyamides; polycarboxylates; polycarboxylic acids, e.g., di-, tri-, or tetra-carboxylate/carboxylic acid; polyisocyanates, e.g., di-, tri-, or tetra isocyanate; polyaldehydes, e.g., di, tri-, or tetra aldehydes (e.g., glutaraldehyde); epoxides, e.g., epoxidized polyamine-polyamide resins; formaldehyde copolymers, such as urea formaldehyde polymers and melamine formaldehyde polymers; and modified melamine formaldehyde polymers (e.g., CYMEL product line available from CYTEC INDUSTRIES Inc.). Example of inorganic cross-linking agents include borates, aluminates, silanes, silicates, phosphates (e.g., trisodium trimetaphosphate), phosphites, and phosphonates. When the coating polymer is a PVOH or copolymer thereof, the cross-linking agent is preferably a borate. The reaction of borates with PVOH is well know in the art to yield a cross-linked gel. See e.g. Casassa et al. "The Gelation of Polyvinyl Alcohol with Borax" J. Chem. Ed. 1986, 63, 57-60. More preferably the borate is a monoborate, a diborate, a triborate, a tetraborate, pentaborate, octaborate, or a metaborate. Even more preferably the borate is a tetraborate, e.g., sodium tetraborate, potassium tetraborate, and ammonium tetraborate. Still more preferably, the borate is borax.

Another important aspect of the present disclosure is the process for the manufacture of the grease resistant article. While the combinations of the herein described cross-linking agent and polymer are well known in the art, the general combination of the above described materials is known to produce a gel or other gelatinous material that has been found unsuitable for forming a permanent, grease resistant coating on a substrate. The benefit of the disclosed material is obtained when the substrate is first treated with the cross-linking agent via a first treatment step and is then treated with the coating polymer via a second treatment step. As used herein, treating and coating are synonymous; generally treatment refers to the process of applying a material to a substrate and coating is the layer or material on the substrate. Preferably, the substrate is treated with the cross-linking agent and is then dried, thereby depositing the cross-linking agent on the substrate. Following the drying of the cross-linking agent-containing substrate, the coating polymer then is added to the substrate, as described in more detail hereinafter.

The method of treating the substrate in the two treatment steps is dependent on the nature of the substrate; a goal of the treatment steps is to provide a uniform application of the cross-linking agent and the polymer solutions to the substrate. Examples of first coating units suitable for obtaining uniform coatings on substrates include impregnation units, knife coating units, wire wound coating bars, roll coaters, spray coaters, size presses, nip presses, and the like. As one non-limiting example, paper can be treated with a cross-linking agent utilizing coaters, e.g., brush and air knife coaters, on-machine coaters, high speed blade coaters, light weight on-machine coaters, Gate roll coaters, double blade coaters, and those coaters presented in Fukui Terunobu, "A Review of Paper Coating. Paper Coating Technologies in the 20th Century", Japan TAPPI Journal, 2001, 55, 1651-1667 and Jerzy Wypych, Polymer Modified Textile Materials (John Wiley & Sons 1988), both of which incorporated herein by reference. Another non-limiting example applicable to paper is the treatment of pulp with a cross-linking agent, either by the addition of the cross-linking agent to the pulper (wherein the pulper is the first coating unit) or by adding, e.g., spraying, the cross-linking agent onto the pulp on the paper-making wire. Additional non-limiting examples include spray coating, e.g., utilizing a spray arm with preferably a plurality of spray nozzles, dip coating, painting, re-wetting with cross-linker and polymer(s) at the waterbox of a papermill, and the like. Substrates other than paper may require adaptation or augmentation of the treatment methods, these adaptations or augmentations are within the knowledge of one of ordinary skill in the art.

The drying of the substrate after treating with the cross-linking agent can include the application of heat, the application of vacuum, the application of both heat and vacuum, or the air drying of the substrate. Applicable methods for any particular substrate are known to those of ordinary skill in the art. As used herein, dry and drying mean that water or other solvents were removed from the substrate to the point that reapplication of water or other solvent would darken or visibly wet the substrate. Preferably, dry or drying is to about 10% by wt. to about 20% by weight water or other solvent, but may be 0% to about 20% by weight.

The method of treating the cross-linking agent-coated-substrate with the coating polymer is dependent on the nature of the substrate; a goal of the treating is to provide a uniform application of the coating polymer on the substrate. As one non-limiting example, a second coating unit can be a brush and/or air knife coater, on-machine coater, high speed blade coater, light weight on-machine coater, Gate roll coater, double blade coater, and those coaters presented in Fukui Terunobu, "A Review of Paper Coating. Paper Coating Technologies in the 20th Century", Japan TAPPI Journal, 2001, 55, 1651-1667 and Jerzy Wypych, Polymer Modified Textile Materials (John Wiley & Sons 1988), both of which incorporated herein by reference. Additional non-limiting examples of methods include spray coating, e.g., utilizing a spray arm with preferably a plurality of spray nozzles, dip coating, painting, and the like. Substrates other than paper may require adaptation or augmentation of the treatment methods, these adaptations or augmentations are within the knowledge of one of ordinary skill in the art.

Without being bound to theory, the process for the manufacture of the grease resistant articles described herein is believed to benefit from both the individual treatment of fibers in fiberous substrates and the formation of cross-linked density gradients. First, the individual treatment of fibers in a fiberous substrate, e.g. paper, is believed to be effectuated by the two step treatment process described above. The individual fibers are believed to be first coated with the cross-linking agent and then coated with the coating polymer. This subsequent treatment of the polymer is believed to allow the polymer to individually coat the fibers as opposed to coat the surface of the substrate (leaving voids in a roughened substrate surface). Furthermore, the herein described process is believed to yield a polymer coating wherein a percentage of polymer cross-linking is higher at the substrate/polymer interface and lower at a free polymer surface furthest away from the substrate surface. The process is additionally believed to yield a cross-link density gradient in between the substrate interface and the face polymer surface. Moreover, it is believed that the process described herein significantly enhances both the mechanical and chemical bonding of the coating to the substrate.

Physical characteristics of the grease resistant articles described herein can be modified by changing the amount of coating polymer added to the substrate and by changing the coating polymer to cross-linking agent ratio. Preferably, the amount of the coating polymer added to the substrate is sufficient to provide grease resistance. More preferably, the amount of coating polymer utilized in the present disclosure is less then the amount of coating polymer utilized in the art and necessary in the art to provide the same grease resistance. Even more preferably, the amount of coating polymer utilized in the present disclosure is less than 75% of the amount of coating polymer necessary in the art, still more preferably, the amount of coating polymer utilized in the present disclosure is less than 50% of the amount of coating polymer necessary in the art. As a non-limiting example for paper having a basis weight of about 20 pounds per 3,000 square feet, if 200 pounds of polyol per ton of substrate is necessary to obtain a KIT test grease resistance value of 5 in the prior art, then the preferable amount of polyol added to the herein described substrate obtain the same KIT test value is less than 100 pounds per ton of substrate, more preferably less than 50 pounds per ton of substrate. The amount of polymer added is preferably about 1 to about 200 pounds per ton of substrate, more preferably about 5 to about 150 pounds per ton of substrate, even more preferably about 10 to about 100 pounds per ton of substrate, still more preferably about 10 to about 50 pounds per ton of substrate. One of ordinary skill in the art would recognize that wherein a sheet of 20 pound basis weight paper may need 50 pounds polymer per ton of paper, a sheet of 40 pound basis weight paper may only need about 25 pounds polymer per ton of paper and a sheet of 80 pounds basis weight paper may only need about 12 pounds polymer per ton of paper.

Likewise the ratio of the coating polymer to cross-linking agent is sufficient to provide grease resistance to the substrate. The benefits of substantial grease resistance of the present disclosure are achieved when the ratio of polymer to cross-linking agent is low, relative to the prior art. Preferably, the mass ratio of the polymer to cross-linking agent is less than about 10:1. More preferably the mass ratio is less than about 5:1, and even more preferably the mass ratio is less than or equal to about 3:1.

Corresponding to the above presented preferred ratio of polymer to cross-linking agent, the preferred amount of cross-linking agent added to the substrate is about 0.1 to about 400 pounds per ton of substrate, more preferably about 1 to about 200 pounds per ton of substrate, most preferably about 5 to about 50 pounds per ton of substrate.

In one preferred embodiment where the polymer is a polyol and the cross-linking agent is borax, the preferred mass ratio of polyol to cross-linking agent is in a range of about 1:10 to about 10:1, more preferably about 1:1 to about 8:1, even more preferably about 2:1 to about 7:1, still more preferably about 3:1 to about 6:1.

When the substrate is paper, the coating is preferably applied during the paper making process. The treatment of the paper with the cross-linking agent, preferably borax, can be accomplished by any of the methods outlined above. Preferably the borax is added as a water based solution to the paper.

Referring to FIG. 1, the addition of the cross-linking agent to paper fibers can occur at one or more places on a paper machine 100. For example, this fiber treatment can be carried out by spraying the cross-linking agent or a solution thereof onto the paper fibers at one or more locations 200-202 in the forming section 102 of the paper machine 100 and/or at a location 203 within or at a location 204 after the press section 103 and before the dryer sections 104-105 and/or at a location 205 after a first dryer section 104 but before a second dryer section 105. The location where the coating polymer is added to the paper fibers in dependent on the location of the addition of the cross-linking agent. In one non-limiting example, the cross-linking agent can be applied at a location 204 after the press section 103 and before the first dryer section 104. The coating polymer could then be added at a location 205 after the first dryer section 104 and before the section dryer section 105. Other possibilities include the addition of the cross-linking agent at a location before the headbox 101, in the flow line from the pulper to the headbox 101, or directly to the pulper. Still other possibilities include the addition of the cross-linking agent and the coating polymer to the substrate or the coating polymer to the cross-linking agent treated substrate at the waterbox of a papermill, or off of the paper making line, for example through the use of an off-line coater well.

The coated substrates described herein were tested for repellency of grease, and oil by a Kit Test (TAPPI T 559 pm-96) and by a Fatty Acid Test (FA Test). The Kit Test was designed for testing paper and board treated with fluorochemical sizing agents, which are replaced with the herein described coatings. The Kit Test, well known in the paper and board coating art, involves the addition of a drop of a test solution, shown in Table 1, onto the substrate. The test solution is quickly removed after 15 seconds and any darkening of the substrate (wetting) is recorded. The Kit Testing is repeated until the highest number kit solution that does not cause failure (wetting) is identified.

TABLE 1

Mixtures of reagents for preparing Kit Test (TAPPI T 559 pm-96) solutions.

| Kit No. | Castor Oil, g | Toluene, ml | n-heptane, ml |
|---|---|---|---|
| 1 | 960.0 | 0 | 0 |
| 2 | 872.1 | 50 | 50 |
| 3 | 775.2 | 100 | 100 |
| 4 | 678.3 | 150 | 150 |
| 5 | 581.4 | 200 | 200 |
| 6 | 484.5 | 250 | 150 |
| 7 | 387.6 | 300 | 300 |
| 8 | 290.7 | 350 | 350 |
| 9 | 193.8 | 400 | 400 |
| 10 | 96.9 | 450 | 450 |
| 11 | 0 | 500 | 500 |
| 12 | 0 | 450 | 550 |

The Fatty Acid Test (FA Test) differs from the Kit Test a number of ways, one of the most significant is that the substrates and test solutions are maintained at 60° C. which speeds the failure (wetting) of a substrate. The FA Test is similar to the Kit Test in that it involves a series of test mixtures, shown in Table 2.

TABLE 2

Mixtures of reagents for preparing Fatty Acid Test solutions.

| | Composition (% wt.) | | |
|---|---|---|---|
| Mixture | Castor Oil | Oleic Acid | Octanoic Acid |
| 1 | 100 | 0 | 0 |
| 2 | 50 | 50 | 0 |
| 3 | 30 | 70 | 0 |
| 4 | 0 | 100 | 0 |
| 5 | 0 | 80 | 20 |
| 6 | 0 | 70 | 30 |
| 7 | 0 | 55 | 45 |
| 8 | 0 | 35 | 65 |
| 9 | 0 | 20 | 80 |
| 10 | 0 | 10 | 90 |
| 11 | 0 | 0 | 100 |

The FA Test is accomplished by warming the substrate to 60° C. and then applying a pre-warmed test mixture in the same manner as the Kit Test. The substrate and test solution are then stored at 60° C. for five minutes, and then a failure (wetting) is noted. The FA Testing is repeated until the highest number test solution that does not cause failure (wetting) is identified.

As used herein, grease resistant means articles preferably have a Kit test rating of at least 1, preferably a rating greater than 2, still more preferably greater than 3. Grease resistant additionally means that the articles preferably have a FA Test rating of at least 1, preferably a rating greater than 3, still more preferably greater than 5. Often the level of grease resistance of paper is dependent on the application, for example for quick service restaurant (QSR) applications the FA Test value is preferably greater than 2, more preferably in a range of 3-4; wherein the low value is often obtained by limiting the amount of coating applied to the paper. For pizza box or pet food bag applications the FA Test value is preferably greater than 5, more preferably in a range of 6-8. For microwave popcorn applications the FA Test value is preferably greater than 8.

The grease resistant articles described above are useful for forming into containers for oil and/or grease containing items. Importantly, the materials used to form the above described articles are generally approved for contact with food and food stuffs, for example, for use in quick service restaurant wraps, french-fry sleeves, dog food bags, and microwave popcorn bags. The application of the above described grease resistant articles as a container for microwave popcorn fully illustrates the beneficial features of the articles. Microwave popcorn is packaged in flexible paper bags containing a microwave susceptor as a slurry including popcorn kernels and a oil material. The popping of the kernels requires the application of microwave energy and a sufficient increase in temperature oil and the kernels.

The herein described articles are grease resistant, flame resistant, printable, and gluable, all important features for the construction of a microwave popcorn bag. Herein, the articles show high FA Test values indicative of superior grease resistance at the elevated temperatures necessary to pop the kernels. Additionally, the articles show flame resistance, preferably the articles herein are self-extinguishing, an important feature in the design of microwave popcorn bags where popped kernels often scorch during popping. The herein described grease resistant articles are preferably printable, that is images and/or lettering can be applied to the articles by methods known in the art. Similarly, the herein described grease resistant articles are preferably gluable, for example a sheet of grease resistant paper described above can be folded upon itself and glued to form a structure capable of holding food. Preferably, the application of an adhesive or a glue to the grease resistant paper is not inhibited by the presence of the grease resistant coating allowing for the application of adhesive to any side of the paper. As commercial microwave popcorn bags are printed and glued to form containers for the oil containing popcorn slurry and are then heated to about 200° C. to pop the kernels, the above described articles provide the microwave popcorn manufacturer with a single article that can be printed, shaped and used as a container for popcorn.

EXAMPLES

The following examples are provided to illustrate the invention, but are not intended to limit the scope thereof. Example 1 are samples of articles treated by the above described methods and tested for grease resistance. Example 2 are samples of articles coated by the above described methods wherein the coating polymer is a blend of a poly(vinyl alcohol) and another polymer. Comparative samples are included in both Example 1 and Example 2 wherein the cross-linking agent was omitted from the method.

The general procedure was followed for all of the samples produced, recognizing that comparative examples omitted the borax treatment step. Generally: a 8 inch by 11 inch sheet of uncoated 20 pound paper was dried at 105° C. for 2 minutes in a speedy drier, then coated with an aqueous crosslinker, e.g., borax solution using a #1.5 Mayer Rod, providing a 0.0015 inch (3.8 μm) thick coat of the solution (approximate coverage 10,700 ft2/gal (263 m2/l) and a wet film weight of 0.94 lbs/1000 ft2 (3.8 g/m2)). The paper was then dried for 2 minutes at 105° C. Next, the paper was coated with an aqueous coating polymer solution using a #1.5 Mayer Rod and then the paper was dried for 2 minutes at 105° C. The, as dried, paper was tested for repellency of grease and oil by the Kit Test (TAPPI T 559 pm-96) and by the Fatty Acid Test.

Significant variability was observed in the adsorption of the paper after the treatment of the paper with the crosslinker solution. Without being bound to any particular theory, it is believed that these variabilities are due in part to the wicking properties of the paper after borax addition and to the rapid reaction of the polyol with the borax. The reported values for pounds of borax per ton of paper were calculated by weighing the paper after the first drying, coating the sheet and drying the sheet, and then re-weighing and measuring the area coated. This provides a measure of the grams of coating per square centimeter, that value is then converted to pounds per ton of paper. The reported values for pounds of polymer per ton of paper were calculated in the same way.

The provided examples employ polyols of varying viscosity and hydrolyzation. The series tested and reported herein are the ELVANOL brand of polyvinyl alcohols available from DUPONT Co., Wilmington Del. Table 3 lists the general characteristics of this series of ELVANOL polymers.

TABLE 3

| Representative Polyols[1] | % hydrolyzed | Viscosity (cP)[2] |
|---|---|---|
| ELVANOL 51-05 | 87-89 | 5-6 |
| ELVANOL 52-22 | 87-89 | 23-27 |
| ELVANOL 50-42 | 87-89 | 44-50 |
| ELVANOL 70-06 | 98-99 | 6-7 |
| ELVANOL 71-30 | 98-99% | 27-33 |

[1]ELVANOL polyols are hydrolyzed polyvinyl alcohols (PVOH) available from DUPONT Co., Wilmington DE.
[2]4% solids aqueous solution at 20° C.

Example 1

Samples 1-5 presented in Table 4 provide representative test data of grease resistance for coatings of the polyols used throughout Example 1. These samples were prepared by the general method, above, where the coating of the paper with borax was omitted. The aqueous coating polymer solution was a 7.5 wt. % solution of the polyol in water. The weight of polymer(s) and borax in the following tables are calculated on a dry polymer and dry borax basis.

TABLE 4

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 0 | none | 0 | 0 | 0 | 0 | 0 |
| 1 | ELVANOL 51-05 | 68.7 | 0 | 7 | 0 | 1.075 |
| 2 | ELVANOL 52-22 | 107 | 0 | 3 | 0 | 1.743 |
| 3 | ELVANOL 50-42 | 66 | 0 | 7 | 2 | 1.108 |
| 4 | ELVANOL 70-06 | 46 | 0 | 3 | 0 | 0.766 |
| 5 | ELVANOL 71-30 | 51.7 | 0 | 5 | 0 | 0.863 |

Samples 6-10 presented in Table 5 provide test data for paper first treated with an aqueous 2.5 wt. % borax solution and then an aqueous 7.5 wt. % coating polymer solution. The application ratio of polymer to cross-linking agent was 3:1.

TABLE 5

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 6 | ELVANOL 51-05 | 52.4 | 7.5 | 12 | 8 | 0.880 |
| 7 | ELVANOL 52-22 | 52.7 | 19.8 | 11-12 | 6 | 0.880 |
| 8 | ELVANOL 50-42 | 104.5 | 33.8 | 8 | 0 | 1.694 |
| 9 | ELVANOL 70-06 | 71.9 | 6.5 | 9 | 3 | 1.205 |
| 10 | ELVANOL 71-30 | 66.6 | 6.6 | 10 | 1 | 1.108 |

Samples 11-15 presented in Table 6 provide test data for paper first treated with an aqueous 5 wt. % borax solution and then an aqueous 7.5 wt. % coating polymer solution. The application ratio of polymer to cross-linking agent was 1.5:1.

TABLE 6

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 11 | ELVANOL 51-05 | 88.7 | 22.2 | 12 | 7 | 1.482 |
| 12 | ELVANOL 52-22 | 59.6 | 39.7 | 8-10 | 3 | 1.091 |
| 13 | ELVANOL 50-42 | 86.6 | 26.7 | 8 | 5 | 1.450 |
| 14 | ELVANOL 70-06 | 78.5 | 26.2 | 11 | 8 | 1.303 |
| 15 | ELVANOL 71-30 | 99.9 | 33.3 | 9 | 1 | 1.661 |

Samples 16-20 presented in Table 7 provide test data for paper first treated with an aqueous 7.5 wt. % borax solution and then an aqueous 7.5 wt. % coating polymer solution. The application ratio of polymer to cross-linking agent was 1:1. The higher concentration of borax required the addition of about 2.5 wt. % to about 7.5 wt. % of glycerol to the aqueous borax solution prior to coating.

TABLE 7

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 16 | ELVANOL 51-05 | 67.4 | 37.4 | 10 | 1 | 1.124 |
| 17 | ELVANOL 52-22 | 93.3 | 93.3 | 7 | 6 | 1.564 |
| 18 | ELVANOL 50-42 | 162 | 47.5 | 10 | 4 | 2.704 |
| 19 | ELVANOL 70-06 | 84.2 | 83.9 | 12 | 8 | 1.401 |
| 20 | ELVANOL 71-30 | 100.2 | 66.9 | 9 | 3 | 1.661 |

Samples 21-25 presented in Table 8 provide test data for paper first treated with an aqueous 2.5 wt. % borax solution and then an aqueous 5 wt. % coating polymer solution. The application ratio of polymer to cross-linking agent was 2:1.

TABLE 8

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 21 | ELVANOL 51-05 | 47.2 | 6.7 | 9 | 4 | 0.782 |
| 22 | ELVANOL 52-22 | 39.7 | 26.5 | 11-12 | 6 | 0.668 |
| 23 | ELVANOL 50-42 | 46.4 | 26.5 | 9 | 1 | 0.782 |
| 24 | ELVANOL 70-06 | 68.8 | 13.8 | 7 | 3 | 1.157 |
| 25 | ELVANOL 71-30 | 53.1 | 19.9 | 10 | 8 | 0.880 |

Samples 26-30 presented in Table 9 provide test data for paper first treated with an aqueous 5 wt. % borax solution and then an aqueous 5 wt. % coating polymer solution. The application ratio of polymer to cross-linking agent was 1:1.

TABLE 9

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 26 | ELVANOL 51-05 | 66.5 | 22.2 | 12 | 8 | 1.108 |
| 27 | ELVANOL 52-22 | 39.7 | 33.1 | 9 | 5 | 0.668 |
| 28 | ELVANOL 50-42 | 60.7 | 33.8 | 9 | 1 | 1.010 |
| 29 | ELVANOL 70-06 | 52.3 | 32.6 | 11 | 8 | 0.880 |
| 30 | ELVANOL 71-30 | 27 | 26.6 | 9 | 3 | 0.440 |

Samples 31-35 presented in Table 10 provide test data for paper first treated with an aqueous 7.5 wt. % borax solution and then an aqueous 5 wt. % coating polymer solution. The application ratio of polymer to cross-linking agent was 0.66:1. The higher concentration of borax required the addition of about 2.5 wt. % to about 7.5 wt. % of glycerol to the aqueous borax solution prior to coating.

TABLE 10

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 31 | ELVANOL 51-05 | 52.4 | 44.9 | 9 | 0 | 0.880 |
| 32 | ELVANOL 52-22 | 73.5 | 100 | 7 | 3 | 1.222 |
| 33 | ELVANOL 50-42 | 88.8 | 40.9 | 8 | 0 | 1.482 |
| 34 | ELVANOL 70-06 | 65.4 | 58.8 | 10 | 4 | 1.091 |
| 35 | ELVANOL 71-30 | 88.6 | 67 | 10 | 2 | 1.450 |

Samples 36-40 presented in Table 11 provide test data for paper first treated with an aqueous 2.5 wt. % borax solution and then an aqueous 2.5 wt. % coating polymer solution. The application ratio of polymer to cross-linking agent was 1:1.

TABLE 11

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 36 | ELVANOL 51-05 | 44.4 | 7.4 | 9 | 0 | 0.733 |
| 37 | ELVANOL 52-22 | 40.2 | 26.8 | 9 | 3 | 0.668 |
| 38 | ELVANOL 50-42 | 13.3 | 13.4 | 9 | 4 | 0.228 |
| 39 | ELVANOL 70-06 | 33.0 | 6.6 | 8 | 0 | 0.554 |
| 40 | ELVANOL 71-30 | 13.5 | 13.5 | 9 | 3 | 0.228 |

Samples 41-45 presented in Table 12 provide test data for paper first treated with an aqueous 5 wt. % borax solution and then an aqueous 2.5 wt. % coating polymer solution. The application ratio of polymer to cross-linking agent was 0.5:1.

TABLE 12

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 41 | ELVANOL 51-05 | 15.0 | 23.3 | 9 | 3 | 0.244 |
| 42 | ELVANOL 52-22 | 46.4 | 33.1 | 7 | 1 | 0.782 |
| 43 | ELVANOL 50-42 | 21.1 | 40.4 | 8 | 6 | 0.326 |
| 44 | ELVANOL 70-06 | 71.9 | 32.6 | 8 | 3 | 1.205 |
| 45 | ELVANOL 71-30 | 33.8 | 27.0 | 8 | 3 | 0.570 |

Samples 46-50 presented in Table 13 provide test data for paper first treated with an aqueous 7.5 wt. % borax solution and then an aqueous 2.5 wt. % coating polymer solution. The application ratio of polymer to cross-linking agent was 0.33:1. The higher concentration of borax required the addition of about 2.5 wt. % to about 7.5 wt. % of glycerol to the aqueous borax solution prior to coating.

TABLE 13

| | Polyol | Lbs. Polyol per Ton of paper | Lbs Borax per Ton of paper | KIT Test Result | FATTY ACID Test Result | Polyol coat weight g/m$^2$ |
|---|---|---|---|---|---|---|
| 46 | ELVANOL 51-05 | 29.7 | 51.9 | 9 | 2 | 0.489 |
| 47 | ELVANOL 52-22 | 33.3 | 53.3 | 5 | 1 | 0.554 |
| 48 | ELVANOL 50-42 | 33.7 | 40.5 | 10 | 3 | 0.570 |
| 49 | ELVANOL 70-06 | 26.0 | 45.8 | 8 | 0 | 0.440 |
| 50 | ELVANOL 71-30 | 33.1 | 59.6 | 7 | 2 | 0.554 |

Example 2

Samples presented in Example 2 were prepared from blends of polymers. These polymer blends were dissolved to provide a 5 wt. % polymer blend solution in water and then applied as provided in the General Procedure. Example 2 includes comparative samples, i.e., without cross-linking agent, and samples wherein the cross-linking agent was applied as provided in the General Procedure. The cross-linking agent shown in these samples was borax and was provided as a 5 wt. % borax solution in water.

In Table 14, Samples 51, 53, and 55 are comparative samples wherein the borax was omitted. Sample 52 shows the effect of borax on a sample employing ethylated starch available from PENFORD PRODUCTS Co., Cedar Rapids Iowa. Sample 54 is previously presented Sample 26. Sample 56 shows the effect of including ethylated starch in the coating polymer.

TABLE 14

| | Coating Polymer | Lbs. Coating Polymer per Ton of paper | Lbs Borax per Ton of paper | KIT Test Result | FATTY ACID Test Result |
|---|---|---|---|---|---|
| 51 | Ethylated Starch | 89.13 | 0.00 | 3 | 0 |
| 52 | Ethylated Starch | 40.95 | 27.30 | 5 | 0 |
| 53 | ELVANOL 51-05 | 68.56 | 0.00 | 7 | 0 |
| 54 | ELVANOL 51-05 | 66.50 | 22.20 | 12 | 8 |
| 55 | 75/25 (51-05)/ES[1] | 81.71 | 0.00 | 5 | 0 |
| 56 | 75/25 (51-05)/ES[1] | 41.16 | 20.58 | 12 | 8 |

[1]Coating Polymers were a mixture of 75 wt. % ELVANOL 51-05 and 25 wt. % Ethylated Starch.

In Table 15, Samples 57, 59, 61, and 63 are comparative samples wherein the borax was omitted. Sample 58 shows the effect of borax on a sample employing Methyl Cellulose available from DOW WOLFF CELLULOSICS, Bound Brook N.J. Sample 60 is previously presented Sample 26. Samples 62 and 64 show the effects of including methyl cellulose in the coating polymer.

TABLE 15

| | Coating Polymer | Lbs. Coating Polymer per Ton of paper | Lbs Borax per Ton of paper | KIT Test Result | FATTY ACID Test Result |
|---|---|---|---|---|---|
| 57 | Methyl cellulose | 47.43 | 0.00 | 5 | 0 |
| 58 | Methyl cellulose | 20.60 | 41.21 | 5 | 0 |
| 59 | ELVANOL 51-05 | 68.56 | 0.00 | 7 | 0 |
| 60 | ELVANOL 51-05 | 66.50 | 22.2 | 12 | 8 |
| 61 | 75/25 51-05/MC[1] | 67.67 | 0.00 | 5 | 0 |
| 62 | 75/25 51-05/MC[1] | 54.71 | 27.35 | 12 | 8 |
| 63 | 50/50 51-05/MC[2] | 67.38 | 0.00 | 4 | 0 |
| 64 | 50/50 51-05/MC[2] | 41.18 | 41.18 | 9 | 7 |

[1]Coating Polymers were a mixture of 75 wt. % ELVANOL 51-05 and 25 wt. % Methyl Cellulose.
[2]Coating Polymers were a mixture of 50 wt. % ELVANOL 51-05 and 50 wt. % Methyl Cellulose.

In Table 16, Samples 65, 67, 69, and 71 are comparative samples wherein the borax was omitted. Sample 66 shows the effect of borax on a sample employing Hydroxy Propyl Methyl Cellulose (HMPC) available from DOW WOLFF CELLULOSICS. Sample 68 is previously presented Sample 26. Samples 70 and 72 show the effects of including HMPC in the coating polymer.

TABLE 16

| | Coating Polymer | Lbs. Coating Polymer per Ton of paper | Lbs Borax per Ton of paper | KIT Test Result | FATTY ACID Test Result |
|---|---|---|---|---|---|
| 65 | HMPC[1] | 60.68 | 0.00 | 5 | 0 |
| 66 | HMPC[1] | 36.17 | 28.94 | 4 | 0 |
| 67 | ELVANOL 51-05 | 68.56 | 0.00 | 7 | 0 |
| 68 | ELVANOL 51-05 | 66.50 | 22.20 | 12 | 8 |
| 69 | 75/25 51-05/HPMC[2] | 67.05 | 0.00 | 4 | 0 |
| 70 | 75/25 51-05/HPMC[2] | 79.07 | 21.57 | 12 | 7 |
| 71 | 50/50 51-05/HPMC[3] | 76.73 | 0.00 | 4 | 0 |
| 72 | 50/50 51-05/HPMC[3] | 86.26 | 21.57 | 12 | 6 |

[1]Hydroxyl Propyl Methyl Cellulose (HPMC)
[2]Coating Polymers were a mixture of 75 wt. % ELVANOL 51-05 and 25 wt. % HPMC.
[3]Coating Polymers were a mixture of 50 wt. % ELVANOL 51-05 and 50 wt. % HPMC.

In Table 17, Samples 73, 75, and 77 are comparative examples wherein the borax was omitted. Samples 74, 76, and 78 show the effect of borax on the mixed polymer, coating polymer. In these three samples significant improvement in the grease resistance was observed by the stepwise treatment as provided in the general procedure.

TABLE 17

| | Coating Polymers | Lbs. Coating Polymers per Ton of paper | Lbs Borax per Ton of paper | KIT Test Result | FATTY ACID Test Result |
|---|---|---|---|---|---|
| 73 | 75/25 51-05/pVDC[1] | 60.315 | 0.0000 | 3 | 0 |
| 74 | 75/25 51-05/pVDC[1] | 68.002 | 27.2006 | 8 | 8 |
| 75 | 75/25 51-05/Cwax-PE[2] | 66.368 | 0.0000 | 1 | 0 |
| 76 | 75/25 51-05/Cwax-PE[2] | 67.337 | 26.9349 | 12 | 4 |
| 77 | 75/25 51-05/pEAA[3] | 33.085 | 0.0000 | 1 | 0 |
| 78 | 75/25 51-05/pEAA[3] | 20.289 | 27.0517 | 11 | 4 |

[1]Coating Polymers were a mixture of 75 wt. % ELVANOL 51-05 and 25 wt. % Polyvinylidene chloride.
[2]Coating Polymers were a mixture of 75 wt. % ELVANOL 51-05 and 25 wt. % carnauba wax/polyethylene wax emulsion.
[3]Coating Polymers were a mixture of 75 wt. % ELVANOL 51-05 and 25 wt. % polyethylene-acrylic acid copolymer.

Table 18 shows the effect of different borates on the grease resistance of a coated sheet of paper. The paper was first treated with a borate solution and then treated with either a 2.5 wt. %, 5 wt. % or 7.5 wt. % solution of ELVANOL 70-06. In these samples the relative effects of the borate source can be observed. Samples without borate were provided for reference.

TABLE 18

| | Cross-linking Agent | Lbs. Coating Polymer per Ton of paper | Lbs Borate per Ton of paper | KIT Test Result | FATTY ACID Test Result | wt. % borate solution |
|---|---|---|---|---|---|---|
| | 2.5 wt. % coating polymer | 33 | 0 | 1 | 0 | 0 |
| 79 | Sodium Borate | 33 | 6.6 | 8 | 0 | 2.5 |
| 80 | | 71.9 | 32.6 | 8 | 3 | 5 |
| 81 | | 26 | 45.8 | 8 | 0 | 7.5 |
| 82 | Potassium Borate | 32.2 | 19.4 | 8 | 0 | 2.5 |
| 83 | | 39 | 26 | 7 | 0 | 5 |
| 84 | | 39 | 26 | 7 | 0 | 7.5 |
| 85 | Ammonium Borate | 26.8 | 6.7 | 5 | 0 | 2.5 |
| 86 | | 6.7 | 67 | 5 | 0 | 5 |
| 87 | | 33.5 | 40.2 | 5 | 0 | 7.5 |
| | 5 wt. % coating polymer | 45.2 | 0 | 1 | 0 | 0 |
| 88 | Sodium Borate | 68.8 | 13.8 | 7 | 3 | 2.5 |
| 89 | | 52.3 | 32.6 | 11 | 8 | 5 |
| 90 | | 65.4 | 58.8 | 10 | 4 | 7.5 |
| 91 | Potassium Borate | 90 | 19.4 | 7 | 7 | 2.5 |
| 92 | | 70.3 | 25.6 | 10 | 8 | 5 |
| 93 | | 84.2 | 51.8 | 10 | 8 | 7.5 |
| 94 | Ammonium Borate | 20.1 | 26.8 | 5 | 0 | 2.5 |
| 95 | | 47.05 | 20.15 | 7 | 0 | 5 |
| 96 | | 73.1 | 46.5 | 5 | 0 | 7.5 |
| | 7.5 wt. % coating polymer | 46 | 0 | 3 | 0 | 0 |
| 97 | Sodium Borate | 71.9 | 6.5 | 9 | 3 | 2.5 |
| 98 | | 78.5 | 26.2 | 11 | 8 | 5 |
| 99 | | 84.2 | 83.9 | 12 | 8 | 7.5 |
| 100 | Potassium Borate | 78.4 | 6.5 | 7 | 4 | 2.5 |
| 101 | | 51.6 | 32.3 | 9 | 8 | 5 |
| 102 | | 102.4 | 83.1 | 10 | 7 | 7.5 |
| 103 | Ammonium Borate | 80.4 | 6.7 | 5 | 0 | 2.5 |
| 104 | | 66.7 | 20.03 | 8 | 0 | 5 |
| 105 | | 109.5 | 47.9 | 10 | 0 | 7.5 |

The foregoing description is given for clearness of understanding only, and no unnecessary limitations should be understood therefrom, as modifications within the scope of the invention may be apparent to those having ordinary skill in the art.

What is claimed is:

1. An environmentally safe, grease resistant article comprising:

an absorbent substrate, and a uniform coating of a cross-linked polymer, the cross-linked polymer consisting of (1) about 1 to about 200 pounds of a coating polymer that comprises a polyol per ton of the substrate and (2) about 0.1 to about 200 pounds of a cross-linking agent that comprises a borate per ton of the substrate, and wherein the absorbent substrate was first treated with the cross-linking agent and then treated with the coating polymer; and wherein a mass ratio of the polyol to the cross-linking agent is in a range of about 1:1 to about 5:1.

2. The article of claim 1, wherein the cross-linking agent was applied to the substrate as a solution, the substrate had a liquid content of less than about 20 wt. % liquid when treated with the coating polymer, and the coating polymer was applied as a flowable solution.

3. The article of claim 1, wherein the absorbent substrate is selected from the group consisting of paper, board, cardboard, textile, leather, ceramic, a water-absorbent mineral, and combinations thereof.

4. The article of claim 3, wherein the absorbent substrate comprises fibers selected from the group consisting of natural fibers, synthetic fibers, and mixtures thereof.

5. The article of claim 4, wherein the fibers comprise cellulosic fibers.

6. The article of claim 1, wherein the cross-linking agent further comprises a compound selected from the group consisting of a polycarboxylate, polycarboxylic acid, polyisocyanate, polyaldehyde, urea, urea foinialdehyde, polyamide, formaldehyde copolymer, melamine formaldehyde, borate, aluminate, silane, phosphate, phosphate, phosphonate, epoxide, silicate and a mixture thereof.

7. The article of claim 1, wherein the borate selected from the group consisting of a monoborate, a diborate, a triborate, a tetraborate, a pentaborate, an octaborate, a metaborate and a combination thereof.

8. The article of claim 7, wherein the borate a tetraborate selected from the group consisting of sodium tetraborate, potassium tetraborate, ammonium tetraborate, and mixtures thereof.

9. The article of claim 1, wherein the polyol is selected from the group consisting of a polyvinyl alcohol, a polyvinyl alcohol copolymer, a polysaccharide, a polysaccharide copolymer, and a mixture thereof.

10. The article of claim 9, wherein the polyol consists of a mixture of polyols selected from the group consisting of polyvinyl alcohol, polyvinyl alcohol copolymer, polysaccharide, and polysaccharide copolymer.

11. The article of claim 1, wherein the article has a Kit Test (TAPPI T 559 pm-96) value greater than the Kit Test value of an article coated with a same amount of the polymer but without the cross-linking agent.

12. The article of claim 1, wherein the article is flame resistant.

13. The article of claim 1, wherein the cross-linked polymer is composed of about 5 to about 150 pounds of a coating polymer per ton of the substrate.

14. The article of claim 13, wherein the cross-linked polymer is composed of about 10 to about 50 pounds of a coating polymer per ton of the substrate.

15. The article of claim 1, wherein the cross-linked polymer is composed of about 1 to about 200 pounds of a cross-linking agent for the polymer per ton of the substrate.

16. The article of claim 15, wherein the cross-linked polymer is composed of about 5 to about 50 pounds of a cross-linking agent for the polymer per ton of the substrate.

17. A grease resistant article comprising a substrate and a uniform, grease resistant coating comprising about 1.1 to about 600 pounds of a cross-linked polymer per ton of the substrate mechanically and chemically adhered to the substrate having a percentage of polymer cross-linking higher at a substrate/polymer interface than at a free polymer surface farthest away from the substrate/polymer interface;

wherein the cross-linked polymer is a reaction product of a polyol selected from the group consisting of polyvinyl alcohol a polyvinyl alcohol copolymer, a polysaccharide, a polysaccharide copolymer, and a mixture thereof and a cross-linking agent selected from the group consisting of a monoborate, a diborate, a triborate, a tetraborate, a pentaborate, an octaborate, a metaborate and a combination thereof; and wherein a mass ratio of the polyol in the cross-linked polymer to the cross-linking agent in the cross-linked polymer is in a range of about 1:1 to about 5:1.

18. The article of claim 17, wherein the percentage of polymer cross-linking is a gradient such that the degree of polymer cross-linking is highest at the substrate/polymer interface and lowest at the free polymer surface farthest away from the substrate/polymer interface.

* * * * *